US006004162A

United States Patent [19]

Harting et al.

[11] Patent Number: 6,004,162

[45] Date of Patent: Dec. 21, 1999

[54] ASSEMBLY FOR INSTALLATION AND PLUG CONNECTOR CASINGS OR FOR SCREWING ONTO WALL SURFACES

[75] Inventors: Dietmar Harting; Albert Ferderer, both of Espelkamp; Andreas Rüter; Hartmut Schwettmann, both of Rahden, all of Germany

[73] Assignee: Harting KGaA, Espelkamp, Germany

[21] Appl. No.: 09/023,609

[22] Filed: Feb. 13, 1998

[30] Foreign Application Priority Data

Feb. 22, 1997 [DE] Germany ..... 197 07 120

[51] Int. Cl.[6] ..... H01R 13/502

[52] U.S. Cl. ..... 439/701; 439/716; 439/532; 439/540.1

[58] Field of Search ..... 248/73, 27.1, 27.3, 248/56, 906, 313, 316.5, 526, 316.3; 439/701, 715, 716, 532, 540.1; 361/802, 796, 818, 705, 730, 752, 784

[56] References Cited

U.S. PATENT DOCUMENTS

| | | | |
|---|---|---|---|
| 3,072,340 | 1/1963 | Dean | 439/701 X |
| 4,343,528 | 8/1982 | Lucius et al. | 439/701 X |
| 4,674,814 | 6/1987 | Hoshino et al. | 439/701 X |
| 4,693,440 | 9/1987 | Lalonde | 248/316.5 X |
| 4,728,971 | 3/1988 | Salacuse | 248/316.5 |
| 4,737,113 | 4/1988 | Hopper et al. | 439/701 X |
| 4,836,805 | 6/1989 | Poliak et al. | 439/701 X |
| 5,125,854 | 6/1992 | Bassler et al. | 439/701 X |
| 5,288,250 | 2/1994 | Sumida | 439/701 |
| 5,314,357 | 5/1994 | Weidler | 439/701 |
| 5,364,291 | 11/1994 | Hashiguchi | 439/701 X |
| 5,725,397 | 3/1998 | Fukamachi et al. | 439/701 |
| 5,741,160 | 4/1998 | Arnold | 439/701 |

FOREIGN PATENT DOCUMENTS 965560 7/1964 United Kingdom .

OTHER PUBLICATIONS

Harting—Han Series, Jan. 1999.

Schwere Steckverbinder Han–Modular Catalog in German.

Heavy Duty Connectors Han–Modular Catalog in English.

*Primary Examiner*—Derek J. Berger

*Assistant Examiner*—Stephen S. Wentsler

*Attorney, Agent, or Firm*—Dorn, McEachran, Jambor & Keating

[57] ABSTRACT

For a holding frame for holding plug connector modules and for installation in plug connector casings or for screwing onto wall surfaces, the plug connector modules being inserted in the holding frame and holding means on the plug connector modules interacting with recesses provided on opposite wall parts (side parts) of the holding frame, it is proposed that the holding frame be constructed from two halves connected to one another in an articulated manner and that the recesses for holding the plug connector modules be constructed, in the side parts of the holding frame, as openings which are closed all round. Under these circumstances, the holding frame is unfolded for the purpose of inserting the plug connector modules and is then closed, the plug connector modules then being held in a form-locking manner in the holding frame via the holding means.

3 Claims, 3 Drawing Sheets

ASSEMBLY FOR INSTALLATION AND PLUG CONNECTOR CASINGS OR FOR SCREWING ONTO WALL SURFACES

The invention relates to a holding frame for holding plug connector modules and for installation in plug connector casings or for screwing onto wall surfaces, the plug connector modules being inserted in the holding frame and holding means on the plug connector modules interacting with recesses provided on opposite wall parts (side parts) of the holding frame.

Holding frames of this kind serve to hold plug connector modules, the holding frame being equipped with various plug connector modules and then inserted in a plug connector casing, and being screwed to the latter. Under these circumstances, the holding frame must be mechanically stable in order to be able to withstand the plugging-in and pulling forces which occur during the joining-together or separation of the plug connection. From the HARTING Elektronik GmbH firm's company document "Schwere Steckverbinder, Han-Modular, 16 3" ["Heavy plug connectors, Han-Modular, 16 3"], an essentially rectangular holding frame is known which is provided with side walls which extend at right angles to the mounting plane. In this instance, the plug connector modules are provided with latching hooks which engage in a latching manner with the side walls when the plug connector module is introduced into the holding frame, and are thus held firmly in the latter. Replacement, that is to say, in particular, removal/detachment of the plug connector module, is then possible only with special demounting tools.

The underlying object of the invention is to so construct a holding frame of the kind initially mentioned that the plug connector modules can be installed and dismounted in the simplest possible manner. The intention is, however, at the same time to guarantee that the holding frame has a high degree of mechanical stability in order to withstand plugging-in and pulling forces during the joining-together or separation of a plug connection.

This object is achieved through the fact that the recesses are constructed as openings, which are closed all round, in the side parts of the holding frame, that the said holding frame consists of two halves which are connected to one another in an articulated manner, provision being made for separation of the holding frame transversely to the side parts of the frame, and that joints are disposed in the fastening ends of the holding frame in such a way that, when the said holding frame is screwed onto a fastening surface, the frame parts are orientated in such a way that the side parts of the holding frame are orientated at right angles to the fastening surface and the plug connector modules have a form-locking connection with the holding frame via the holding means.

The advantages achieved with the aid of the invention consist, in particular, in the fact that the mounting or demounting of the plug connector modules is possible without special tools. A further advantage consists in the fact that, after the installation of the holding frame in a plug connector casing, the plug connector modules are fastened in the holding frame in a form-locking manner and there is thus a high degree of mechanical stability, as a whole, for absorbing or transmitting the plugging-in and pulling forces of the plug connection.

One exemplified embodiment of the invention is represented in the drawings and will be explained in greater detail below. In the drawings.

Figure 1:
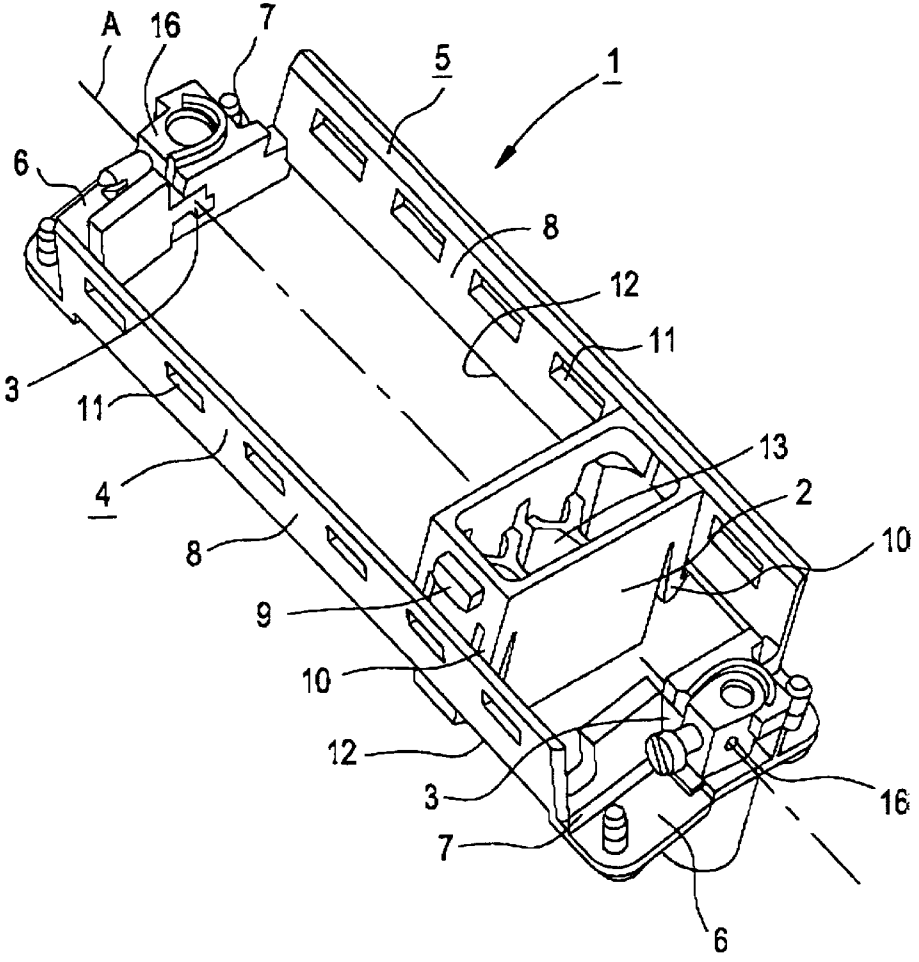
FIG. 1 shows a view of an open holding frame.
Figure 2:
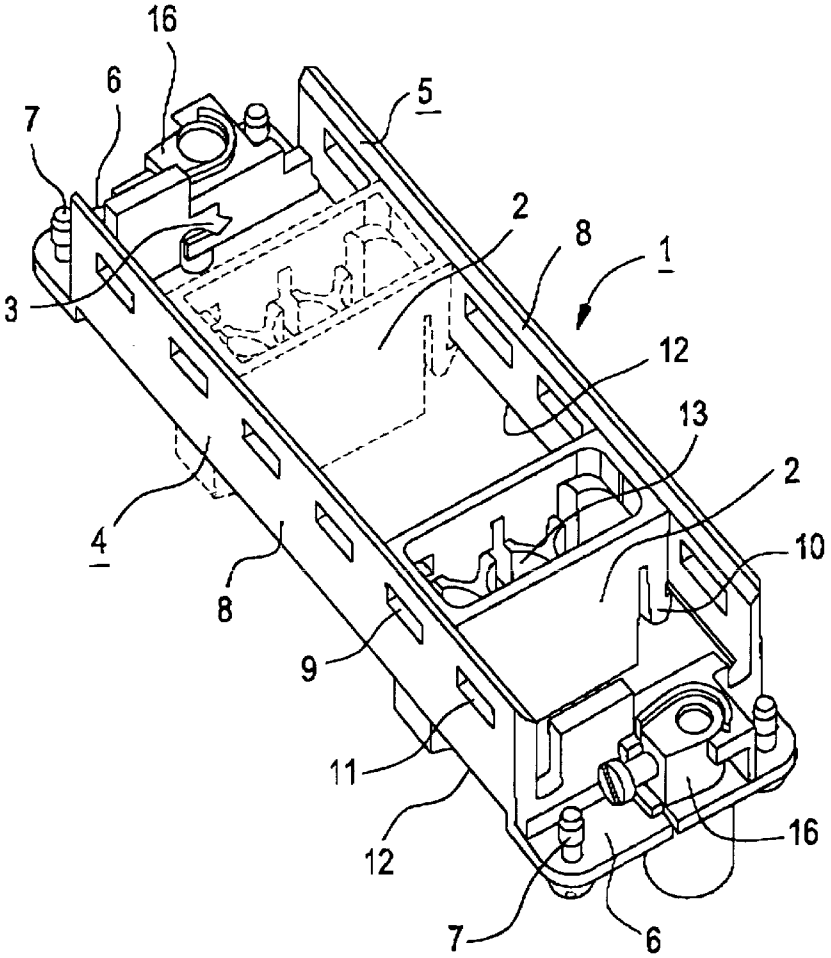
FIG. 2 shows a view of a closed holding frame.

FIGS. 1 and 2 represent a holding frame 1 for plug connector modules 2, the said holding frame being open in FIG. 1 and closed in FIG. 2. The holding frame is intended for installation, after the introduction of plug connector modules, in plug connector casings (in this connection, see FIG. 4) or for fastening, via a perforation, to a fastening surface/mounting wall.

The holding frame consists of two frame halves 4, 5 connected via joints 3 and having fastening ends 6 which are provided with fastening screws 7. Under these circumstances, the joints are provided at the fastening ends of the holding frame, provision being made for the possibility of pivoting the frame halves transversely to the side parts 8 of the holding frame. For the purpose of forming the joints 3, moulded-on portions, which engage in corresponding recesses, are provided on the fastening ends 6 of the holding frame or of the side parts in each case. Under these circumstances, these moulded-on portions are pushed into the recesses by lateral displacement of the side parts, the said side parts subsequently being pivotable (rotatable) about the longitudinal axis A. After the joining-together of the side parts, boundary posts 16, which in this instance are constructed as earthing contacts, are introduced into the fastening ends, the said boundary posts being provided on the outer ends of the side parts in each case, and the joints 3 thus being located between the boundary posts. This arrangement of the boundary posts prevents axial displacement of the side parts.

The plug connector modules are provided with projecting, approximately rectangular holding means 9 and resiliently elastic latching hooks 10. Recesses 11 into which the holding means 9 penetrate when the plug connector modules are introduced into the holding frame, and which are constructed as openings which are closed all round, are provided in the side parts 8 of the frame halves.

Figure 3:
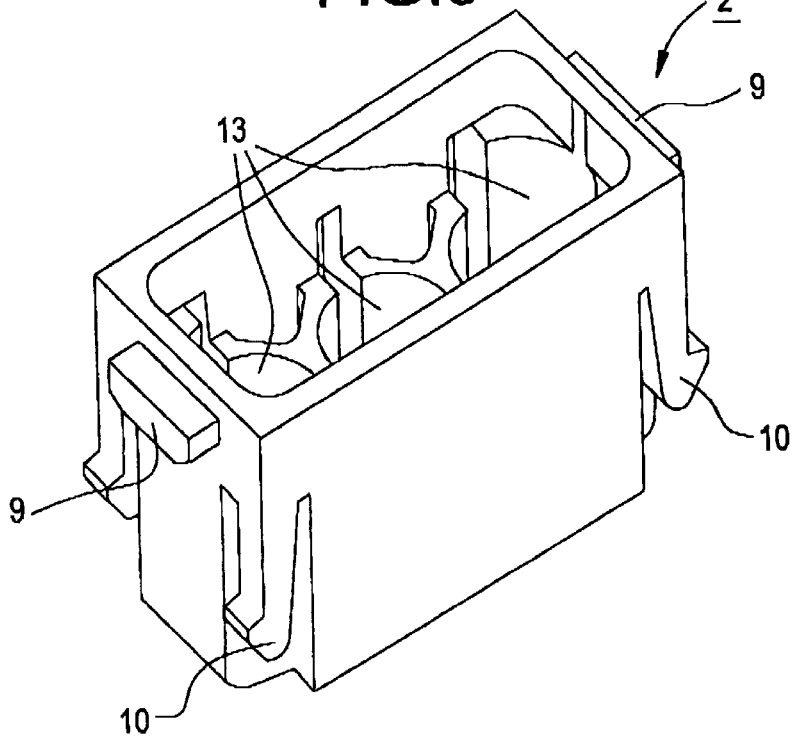
FIG. 3 shows a view of a plug connector module.

For the purpose of introducing the plug connector modules 2, the holding frame 1 is unfolded, that is to say opened, the frame halves 4, 5 being unfolded, about the joints 3, to an extent such that the plug connector modules can be inserted. For the preliminary fixing of the plug connector modules, the latching hooks 10, on being introduced, first of all engage under the lower edges 12 of the side parts 8 of the frame halves. The frame halves 4, 5 are then folded together, that is to say the holding frame is closed, the holding means 9 passing into the recesses 11 and secure, form-locking retention of the plug connection modules 2 in the holding frame being brought about. For the sake of completeness, FIG. 3 represents a plug connector module 2, it being possible to make out more precisely the arrangement and location of the holding means 9 and latching hooks 10. The plug connector module represented is provided with contact clips 13 for the introduction of contact elements, no further details of which are represented here.

Figure 4:
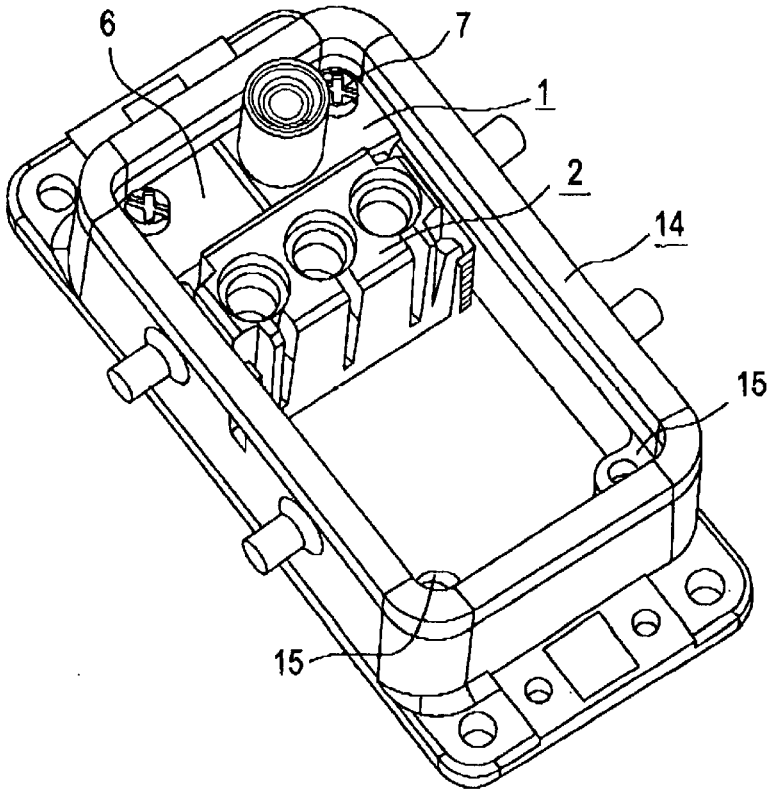
FIG. 4 shows a sectional view of a holding frame in a plug connector casing.

Finally, FIG. 4 shows a holding frame 1 inserted in a plug connector casing 14. Under these circumstances, a cutaway view of the holding frame has been chosen here, so that details can be made out more clearly. The closed position of the holding frame is finally fixed by the screwing of the said holding frame onto the fastening eyes 15 in the corners of the casing, which eyes are located in a fastening plane.

We claim:

1. An assembly for installation in plug connector casings or for screwing onto wall surfaces, said assembly comprising:

a holding frame (1) comprising two halves (4,5), each of said halves comprising fastening ends (6), wherein corresponding fastening ends (6) of each of the halves (4,5) are pivotally connected along a longitudinal axis (A) by a corresponding one of two joints (3), the two halves (4,5) each comprising a side part (8) defining recesses (11) in the form of openings that are closed all round;

a plurality of plug connector modules (2) inserted in the holding frame (1), each of said plurality of plug connector modules (2) having holding means (9) received in a corresponding one of said recesses (11) in each of the side parts (8) of the halves (4,5) of the holding frame (1) when the holding frame (1) is in a closed position; and wherein the joints (3) allow the halves (4,5) of the holding frame (1) to pivot about the longitudinal axis (A) between an open position for inserting said plurality of plug connector modules (2) and said closed position wherein said plurality of plug connector modules (2) have a form-locking connection with the holding frame (1).

2. The assembly according to claim 1, characterized in that each of the plug connector modules (2) are provided with latching hooks (10) for preliminary fixing of the plug connector modules to the holding frame when inserting the uiuralitv of plug connector modules (2) in the holding frame.

3. The Assembly according to claim 1, characterized in that the joints (3) are disposed on the fastening ends (6) between boundary posts (16) which prevent axial displacement of the side parts after they have been joined together.

* * * * *

UNITED STATES PATENT AND TRADEMARK OFFICE

CERTIFICATE OF CORRECTION

PATENT NO. : 6,004,162

DATED : December 21, 1999

INVENTOR(S) : Dietmar Harting, Albert Ferderer, Andreas Ruter and Hartmut Schwettmann

It is certified that error appears in the above-identified patent and that said Letters Patent is hereby corrected as shown below:

On the title page, item [54] and Column 1, line 1, delete "AND" and insert --IN--.

Signed and Sealed this

Fifteenth Day of August, 2000

*Attest:*

Q. TODD DICKINSON

*Attesting Officer*

*Director of Patents and Trademarks*